United States Patent [19]

Hibino

[11] Patent Number: 4,653,939

[45] Date of Patent: Mar. 31, 1987

[54] THERMAL PRINTER

[75] Inventor: Ikuo Hibino, Takizawa, Japan

[73] Assignee: Alps Electric Co., Ltd., Japan

[21] Appl. No.: 682,433

[22] Filed: Dec. 17, 1984

[30] Foreign Application Priority Data

Dec. 16, 1983 [JP] Japan ..... 58-192927[U]

[51] Int. Cl.[4] ..... B41J 3/20

[52] U.S. Cl. ..... 400/120; 400/185; 400/212; 400/216; 400/219; 346/76 PH

[58] Field of Search ..... 400/120, 218, 219, 185, 400/212, 216, 216.1, 216.2, 217, 225, 229; 346/76 PH; 219/216

[56] References Cited

U.S. PATENT DOCUMENTS

| | | | |
|---|---|---|---|
| 3,841,459 | 10/1974 | Buschmann | 400/229 X |
| 3,855,448 | 12/1974 | Hanagata | 400/120 X |
| 3,986,594 | 10/1976 | Kondur | 400/185 |
| 4,030,588 | 6/1977 | Hanagata | 400/120 |
| 4,259,026 | 3/1981 | Hanaoka | 400/185 X |
| 4,280,767 | 7/1981 | Heath | 400/216.2 |
| 4,347,007 | 8/1982 | Schaefer | 400/229 X |
| 4,376,585 | 3/1983 | Fromme | 400/185 |
| 4,397,575 | 8/1983 | Aldrich | 400/217 X |
| 4,438,320 | 3/1984 | Woodard | 400/120 X |
| 4,443,125 | 4/1984 | Hirano | 400/120 X |
| 4,468,139 | 8/1984 | Hattori | 400/120 |
| 4,472,073 | 9/1984 | Valle | 400/216 X |
| 4,484,825 | 11/1984 | Wilczewski | 400/185 X |
| 4,500,892 | 2/1985 | Hirano | 400/120 X |

FOREIGN PATENT DOCUMENTS

| | | | |
|---|---|---|---|
| 120385 | 9/1981 | Japan | 400/218 |
| 2140746 | 12/1984 | United Kingdom | 400/185 |

*Primary Examiner*—Paul T. Sewell

*Attorney, Agent, or Firm*—Guy W. Shoup

[57] ABSTRACT

A single drive source drives a pressing cam to selectively press a thermal head against a thermal transfer tape for printing on a recording paper behind the tape. The tape is divided into three longitudinal printing regions so the thermal head can be reciprocally moved forward, back and forward again respectively over the three regions of the tape before the tape is advanced to a new section. The drive source powers the reciprocating movement of the thermal head and the tape winding as well.

3 Claims, 39 Drawing Figures

THERMAL PRINTER

FIELD OF THE INVENTION

The present invention relates to a thermal printer and particularly to a thermal printer capable of a high speed printing operation.

BACKGROUND OF THE INVENTION

A conventional thermal printer has a printing tape having thermal fusible material disposed thereon positioned between a recording paper and a thermal head, a plurality of heat generating elements provided to the thermal head are selectively heated at successive printing positions during the movement of thermal head, and the data is printed on the recording paper by thermal transfer of the thermally fusible material of the printing tape. This thermal printer does not generates noise during the printing operation and it can print on conventional of recording paper.

In such conventional thermal printer, the thermal head is supported by the carriage which reciprocally moves along the platen and the tape cassette accommodating the printing tape is loaded to this carriage. In the reciprocal movement of the carriage, the printing is carried out only during movement of the thermal head in one direction, resulting in long periods where the thermal head does not print. Namely, during movement in the forward direction the thermal head pressingly contacts against the printing tape but disengages from pressurized contact with the tape when the carriage is returned.

Accordingly, printing is carried out only during the forward portion of the reciprocal movement of the carriage, but not in the return portion of the reciprocal movement of the carriage. Therefore, the printing speed is lowered because the return movement is not productively used to print and it is impossible to expect improvement in the printing efficiency.

The existing thermal printer described above is designed so that only one character, can be printed for given width of the printing tape and threfore it uses a large length of printing tape. As a result, the running cost becomes high and operation becomes uneconomical.

Because a large quantity of printing tape is used, the frequency of replacing the tape cassette accommodating the printing tape is high. Accordingly it is also impossible to expect improvement in the efficiency of printing using conventional thermal printers.

For eliminating the abovementioned disadvantages, another type of thermal printer, which prints two characters across the width of the printing tape, has also been proposed. In this case, both upper and lower parts of the printing tape are used for the printing regions. For example, after the printing over the total printing region of the upper part been completed, the tape cassette is lifted, the printing tape within this tape cassette is moved in the direction opposing to the preceding running direction, and the printing is then carried out on the unused printing region at the lower part.

This type of thermal printer is capable of reducing the quantity of printing tape used and the replacement frequency of the tape cassette as compared with the first-described thermal printer, but the printing is till carried out only during the forward portion of the reciprocal movement (double stroke movement) of the carriage. Accordingly, the printing speed is still the same as that of the existing thermal printer and improvement in the printing work efficiency cannot be expected.

Summary of the Invention It is an object of the present invention to provide a thermal printer which is capable of decreasing the length of printing tape to be used, lessening the replacement frequency of the tape cassette and also realizing high speed printing.

In order to attain such object, the present invention provides a thermal printer comprising a frame a platen on which a recording paper is wound, a carriage which moves along this platen, a thermal head which is loaded on the carriage and is disposed opposing to the platen, a tape cassette which is placed on said carriage and accomodates a printing tape having thermally fusible material, a tape winding mechanism which winds the printing tape in accordance with the movement of carriage, thermal head a shaft which extends along said platen and is rotatable, a head pressing mechanism which presses said thermal head against said platen or restores such the head to the unpressurized position by rotation of the shaft, a tape winding stop mechanism which stops winding of said printing tape in conjugation with rotation of said shaft, and a cassette shift mechanism which sets said, tape cassette to a plurality of vertical levels by rotation of said shaft.

BRIEF DESCRIPTION OF THE DRAWINGS

FIG. 1(*a*) is a plan view, FIG. 1(*b*) is a front elevation, FIG. 1(*c*) is a right side elevation, FIG. 1(*d*) is a left side elevation.

FIG. 2(*a*) is a side elevation, FIG. 2(*b*) is a front elevation, FIG. 2(*c*) is a characteristic diagram.

FIG. 14(*a*) is a side elevation, FIG. 14(*b*) is a front elevation, FIG. 14(*c*) is a characteristic diagram.

FIG. 15(*a*) is a side elevation, FIG. 15(*b*) is a front elevation, FIG. 15(*c*) is a characteristic diagram.

FIG. 16(*a*) is a front elevation and FIG. 16(*b*) is a plan view.

FIG. 17(*a*) is a front elevation, FIG. 17(*b*) is a side elevation and FIG. 17(*c*) is a plan view.

FIG. 18(*a*) is a front elevation, FIG. 18(*b*) is a side elevation, FIG. 18(*c*) is a plan view.

FIG. 19(*b*) shows operation of the printing tape wind-stop mechanism provided to the embodiment shown in FIG. 1.

FIG. 20(*a*) shows the condition that the tape cassette is located at the lower position. FIG. 20(*b*) shows the condition that the tape cassette is located at the intermediate position. FIG. 20(*c*) shows the condition that the tape cassette is located at the upper position.

FIG. 21(*a*) shows the pressurized condition, while FIG. 21(*b*) shows the unpressurized condition.

DETAILED DESCRIPTION 0F THE INVENTION

A thermal printer of the present invention is described with reference to the attached drawings.

FIGS. 1(*a*), (*b*), (*c*) and (*d*) show total structures of an embodiment of the present invention. FIG. 1(*a*) is a plan view, FIG. 1(*b*) is a front elevation, FIG. 1(*c*) is a right side elevation, FIG. 1(*d*) is a left side elevation.

First, the carriage driving mechanism and paper feed mechanism provided to this embodiment are described with reference to FIGS. 1(*a*)–(*d*).

Figure 1A:
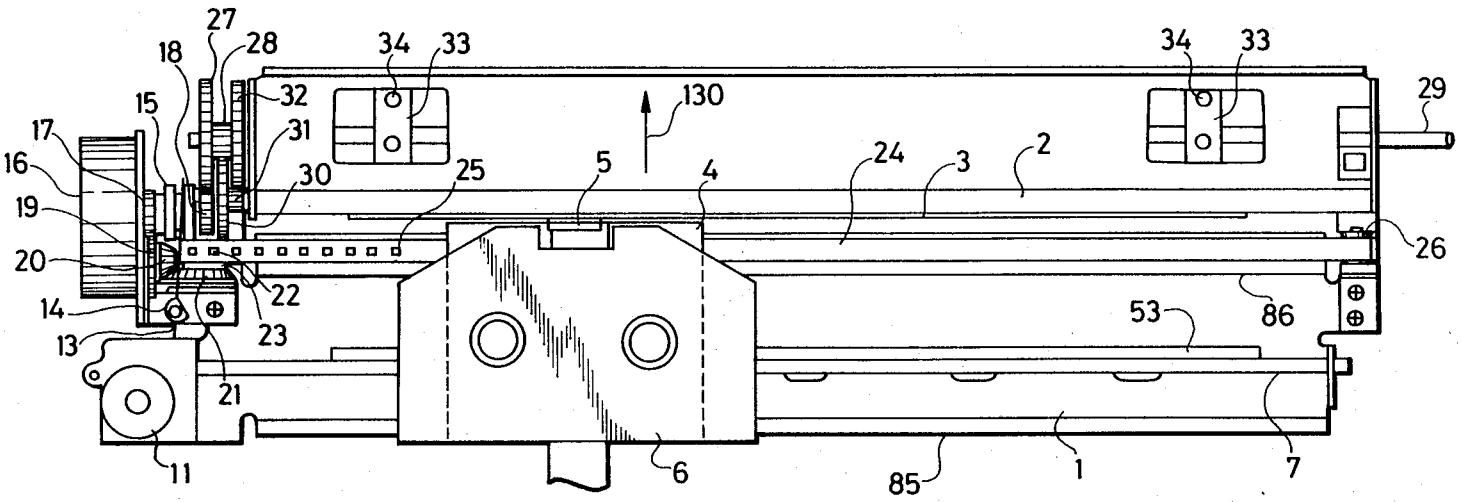
FIG. 1(*a*),(*b*),(*c*),(*d*) show a total structure of an embodiment of the thermal printer of the present invention.
Figure 1B:
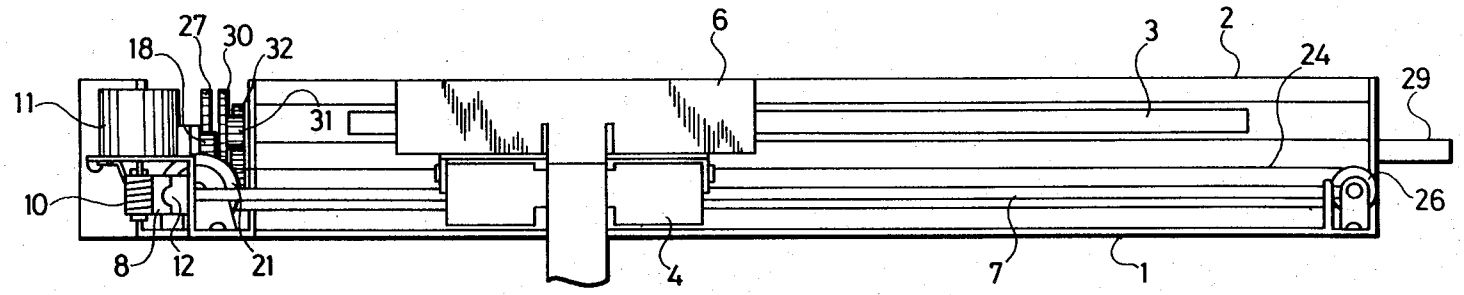
Figure 1C:
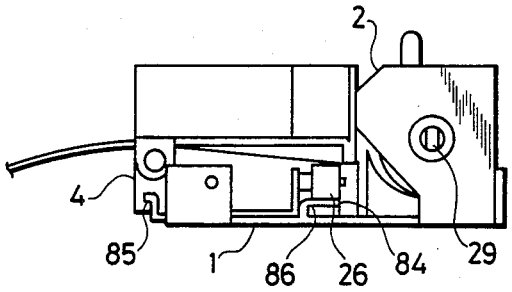
Figure 1D:
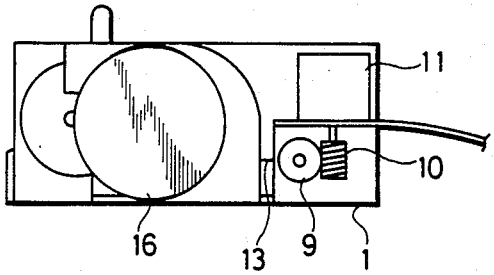
Figure 2A:
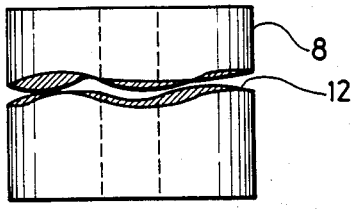
FIG. 2(*a*),(*b*),(*c*) show a cam provided to the embodiment shown in FIG. 1.
Figure 2B:
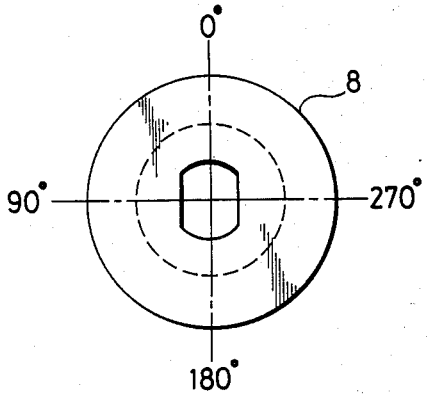
Figure 2C:
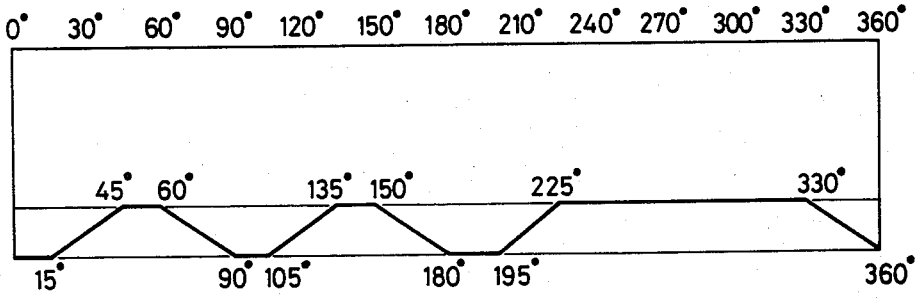

In these figures, 1 is a frame forming the body, 2 is a platen on which the recording paper is wound, and 3 is a rubber contact surface for the print head at the front side of platen 2. 4 is a carriage which moves along the platen 2. 5 is a thermal head which is provided opposing to the platen 2. 6 is a tape cassette arranged on the carriage 4. 7 is a shaft which extends along the platen 2 and passes through the carriage 4 and also rotates. 8 is a cam integrally provided to the shaft 7. 9 shown in FIG. 1(*d*) is a worm wheel which is connected to the cam 8 and connected to the shaft 7. 10 is a worm engaging with the worm wheel 9. 11 is a stepping motor which rotates the worm 10. The cam 8 is shown in the side elevation of FIG. 2(*a*) and the front elevation of FIG. 2(*b*) and is provided with a groove 12 in its side surface having a rotational displacement characteristic of FIG. 2(*c*).

13 shown in FIG. 1(*a*) is a lever having one end part engaging with the groove 12 of cam 8. This lever rotates about the fulcrum 14. The other end thereof is engaging with the cavity of slider 15 which can move in the right and left directions of FIG. 1(*a*). The slider 15 is coupled to the output shaft of stepping motor 16 and gears are formed at both sides. The gears at both sides of slider 15 are selectively engaged with the gears 17, 18 being engaged with play with the output shaft of stepping motor 16.

19 is a gear which engages with the gear 17 and integrally rotates with this gear and is provided with a helical gear 20 at a side. 21 is a helical gear which engages with the helical gear 20 and it is integrated to a pulley having protrusion 22 at the circumference. 24 is a metal belt of which both ends are coupled to the carriage 4 and provides a square hole which engages with the protrusion 22 of pulley 23. 26 is a pulley which is located at the opposite side of pulley 23 and allows winding of the metal belt 24.

The metal belt 24, pulleys 23 and 26, helical gear 21, gear 19 having helical gear 20, gear 17, slider 15 and stepping motor 16 described above form the carriage driving mechanism which moves the carriage 4 along the platen 2, namely in the right and left direction of Fig. 1(*a*).

27 is a gear which engages with the gear 18. This gear has a small diameter gear at the side thereof and is rotatably engaged with the paper feed shaft 29. 30 is a gear engaging with the gear 28 and has a small diameter gear at a side thereof. 32 is a gear engaging with the gear 31 and is rotatably and integrally loaded to the paper feed shaft 29. 33 is a sprocket integrated to the paper feed shaft 29 and provided with protrusions 34 to be engaged with holes formed in both edges of the recording paper.

The sprocket, 33, paper feed shaft 29, gear 32, gear 30 having the gear 31, gear 27 having the gear 28, gear 18, slider 15 and stepping motor 16 form the paper feed mechanism which feeds the recording paper to be wound to the platen 2.

Figure 3:
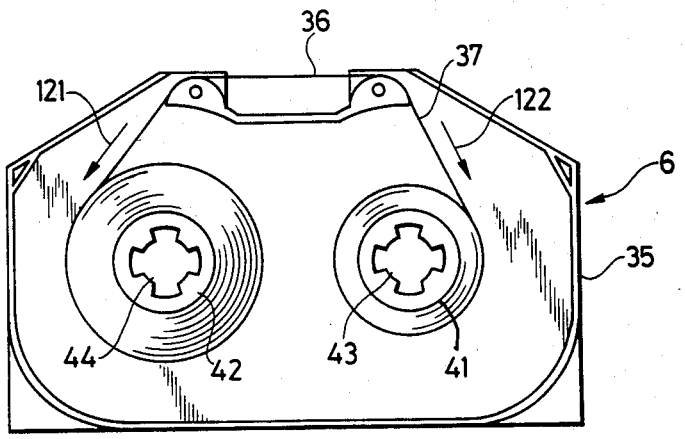
FIG. 3 shows a plan view indicating the inside of the tape cassette provided to the embodiment shown in FIG. 1.
Figure 4:
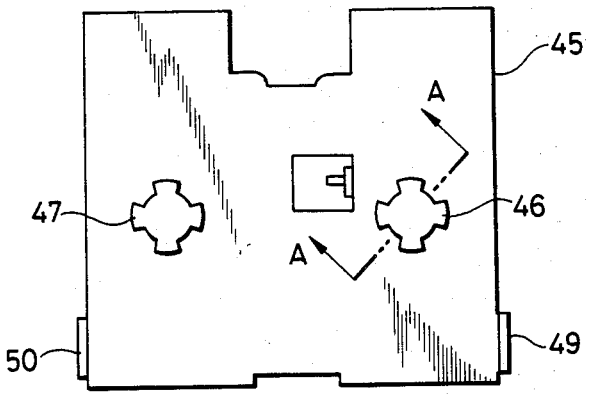
FIG. 4 is a plan view indicating the cassette holding plate listed as an example of the cassette holding means provided to the embodiment shown in FIG. 1.
Figure 5:
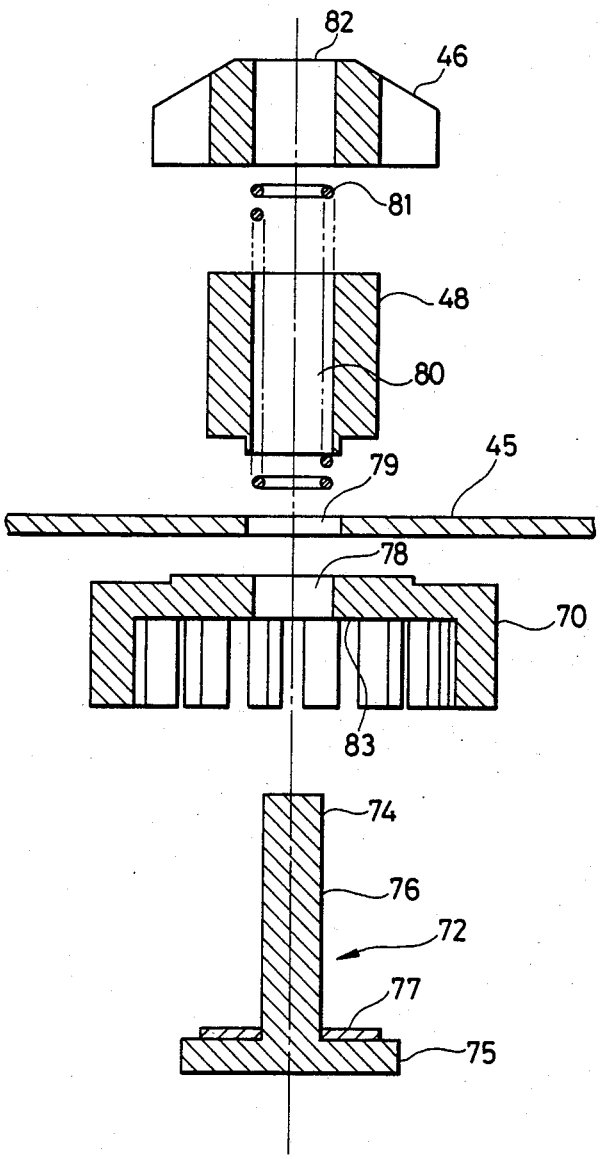
FIG. 5 is an enlarged cross section of FIG. 4 disassembled along the line A—A.
Figure 6:
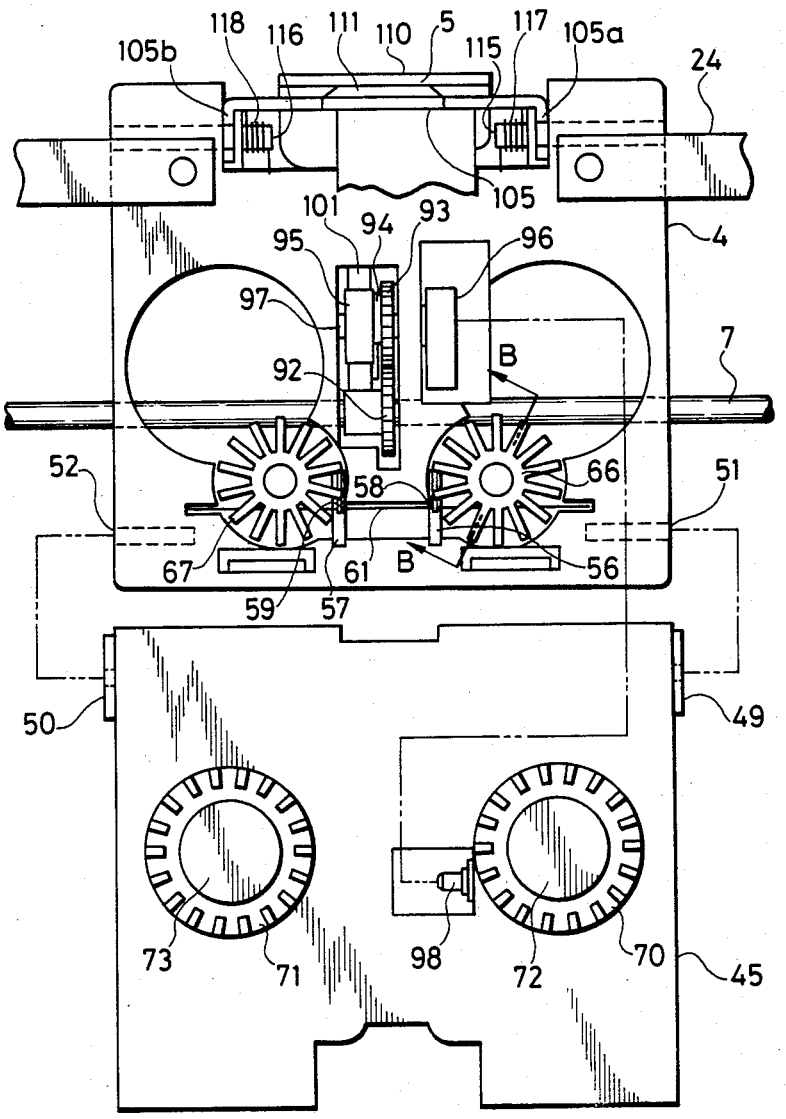
FIG. 6 is a development view indicating the engaging relation between the carriage and cassette holding plate provided to the embodiment shown in FIGS. 7–10 show the carriage provided to the embodiment shown in FIG. 1.
Figure 7:
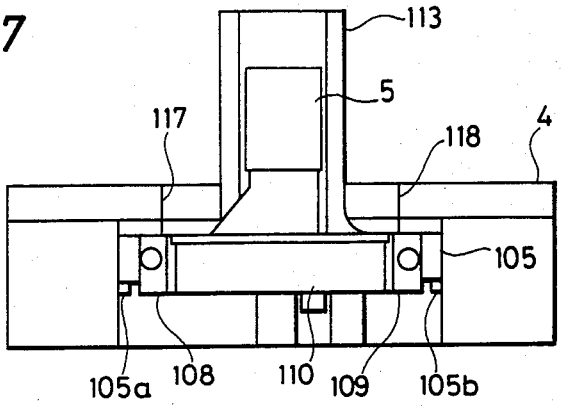
FIG. 7 is a front elevation.
Figure 8:
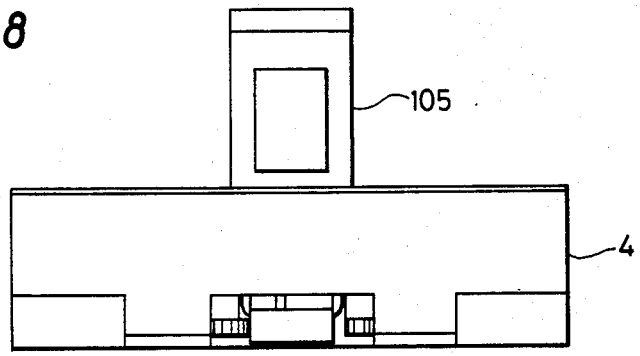
FIG. 8 is a rear elevation.
Figure 9:
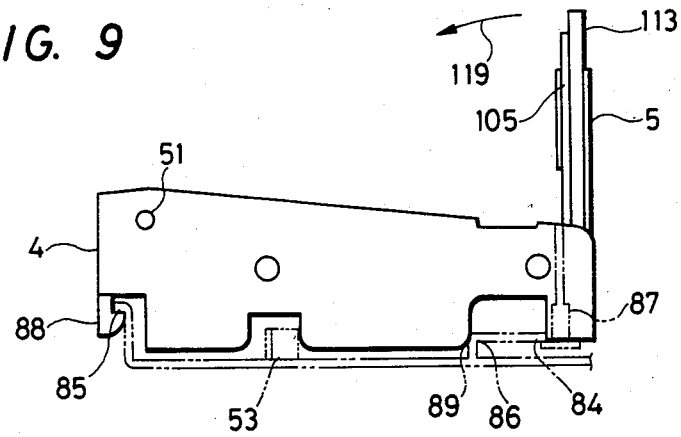
FIG. 9 is a side elevation.
Figure 10:
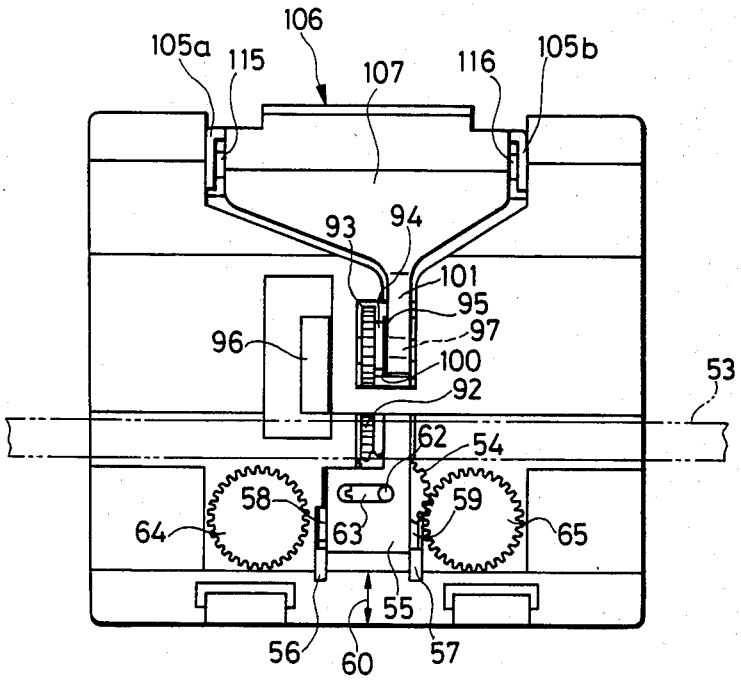
FIG. 10 is a rear side view.
Figure 11:
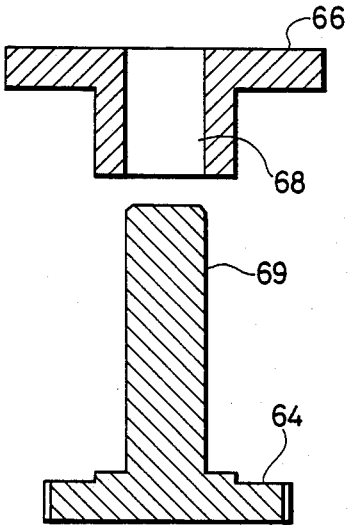
FIG. 11 is an enlarged view of FIG. 6 disassembled along the line B—B.
Figure 12:
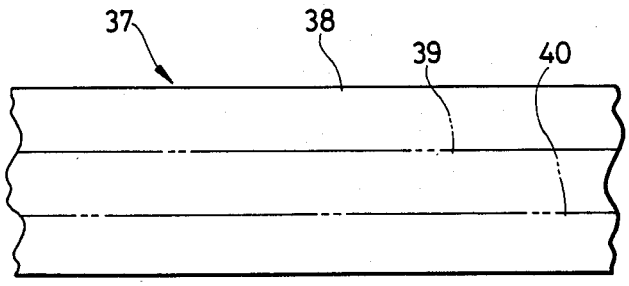
FIG. 12 is a front elevation indicating a part of printing tape provided to the embodiment shown in FIG. 1.

FIG. 3 is a plan view indicating the inside of the tape cassette described above. FIG. 4 is a plan view indicating a cassette holding plate which is listed as an example of a cassette holding means for holding the tape cassette. FIG. 5 an enlarged cross-sectional view along the line A—A in FIG. 4. FIG. 6 is a development view indicating the engagement between the carriage and cassette holding plate described above. FIG. 7 is a front elevation of the carriage. FIG. 8 is rear view of the carriage. FIG. 9 is a side elevation of the carriage. FIG. 10 is a rear view of the carriage. FIG. 11 is an enlaged cross-sectional view along the line B—B in FIG. 6. FIG. 12 is a front elevation indicating a part of the printing tape.

The printing tape winding mechanism, carriage loading mechanism and carriage guiding means to be provided in such embodiment are described with reference to FIG. 3 to FIG. 12, and FIGS. 1(*a*) and (*b*) described above.

In FIG. 3, 35 is a lower portion of tape cassette 6 and is mated with a similar upper case portion (not shown). 36 is a gap in which a thermal head 5 is inserted. 37 is a printing tape having thermally fusible material to be accommodated within the inside of tape cassette 6. As shown in FIG. 12, the, printing regions 38, 39 and 40 are set respectively to the upper, intermediate and lower portins of tape. Each printing region 38, 39, 40 respectively has the width which is sufficient for the printing of one character, for instance. Namely a total of three characters can be printed in the width direction of the printing tape 37.

In FIG. 3, moreover, 41, 42 are a pair of cores on which the printing tape 37 is wound. Each of such cores is rotatably provided within the tape cassette 6 and the cross-shaped holes 43, 44 are formed at the center of such cores.

In FIG. 4 and FIG. 5, 45 is a cassette holding plate which is rotatably loaded to the carriage 4, 46 and 47 are a pair of bobbins having the cross-shaped outline which are engaged with the respective holes 43 and 44 of the cores 41 and 42 described above. The bobbin 46 is located on the cassette holding plate 45 through a hollow shaft 48 as shown in FIG. 5. Although not shown particularly, the bobbin 47 is also located on the cassette holding plate 45 through the hollow shaft which is equivalent to the hollow shaft 48. The cassette holding plate 45 described above is provided with the bearings 49 and 50 at the edge. As shown in FIG. 6, these bearings 49 and 50 are located so that they are engaged with the holes 51 and 52 formed on the carriage 4. Where the pins (not shown) engage with the bearings 49, 50 and the hole of carriage 4, said cassette holding plate 45 is loaded to the carriage 4. In FIG. 6, the rear side of cassette holding plate 45 is indicated.

53 shown in FIG. 1(*a*) and FIG. 10 indicating the rear side of carriage 4 is a rack gear extending along the platen 2. 54 shown in FIG. 10 is a transmission gear being engaged with the rack gear 53. 55 is a moving body loaded to the carriage 4 which is provided, in both sides, with protrusions 58, 59 which are located within the through holes 56 and 57 provided to the carriage 4 and is capable of moving in the direction orthogonally crossing the moving direction of carriage 4 as shown by arrow mark 60. As shown in FIG. 6, the upper part of protrusions 58, 59 of the moving body engages with a line spring 61 loaded, to the carriage 4 and therefore, the moving body 55 is biased by this line spring 61 toward the platen 2. The pivot 62 of said transmission gear 54 is engaged with an elongaged hole 63 formed at the bottom part of the moving body 55 as shown in FIG. 10. Thereby, the transmission gear 54 moves integrally with the moving body 55 in the direction indicated by the arrow 60 and also moves in the elongated hole 63, namely moves in parallel with the moving direction of the carriage 4.

64 and 65 shown in FIG. 10 are a pair of tape winding gears which are loaded rotatably to the carriage 4 and engage selectively with the transmission gear 54. 66, 67 shown in FIG. 6 are a pair of first pin gears which integrally rotate together with the tape winding gears 64 and 65. The first pin gear 66 and tape winding gear 64 are integrated through the structure that the shaft 69 formed at the center of tape winding gear 64 is inserted into the hollow part 68 formed at the center of the first pin gear 66. Moreover, although not shown particularly, the other pair of first pin gear 67 and tape winding gear 65 are also integrated as described above.

70 and 71 shown in FIG. 6 are a pair of second pin gears which respectively engage with the first pin gears 66, 67 and are loaded to the cassette holding plate 45. 72 and 73 are a pair of clutch mechanism provided between the second pin gears 70, 71 and the bobbins 46, 47 shown in FIG. 4 described above. As shown in FIG. 5, the clutch mechanism 72 is composed of a protruded body 76 formed by the shaft 74 and the disk type flat plate 75 and a friction plate 77 formed on the flat plate 75 of this protruded body 76. When the shaft 74 of protruded body 76 is inserted into a hole 79 formed to the cassette holding plate 45, a coil spring 81 located within a hole 80 of hollow shaft 48 and a hole 82 of the bobbin 46, the second pin gear 70 and the bobbin 46 are integrated and rotatably loaded to the cassette holding plate 45. When the friction plate 77 of protruded body 76 rubs against the lower surface 83 of the second pin gear 70 and a rotating force exceeding the specified value is given to the second pin gear 70, only the second pin gear 70 rotates but the protruded body 76 and bobbin 46 do not rotate. Although not shown particularly, the other clutch mechanism 73 also engages with the second pin gear 71 and bobbin 47, etc. as in the case above.

In this embodiment, the winding mechanism for printing tape 37 is constituted with above-mentioned clutch gear 53, transmission gear 54, moving body 55, line spring 61, a pair of tape winding gears 64 and 65, a pair of first pin gears 66 and 67, second pin gears 70 and 71 and clutch mechanisms 72 and 73.

As shown in FIG. 1(*a*) and FIG. 9, the first edge 84 which extends along the platen 2 and located at the area near the platen 2, the second edge 85 located far from the platen 2 and the stepped portion 86 extending along the platen 2 are formed on the frame 1. The pin 87 which engages with the first edge 84 is loaded to the carriage 4 located in the side of platen 2. The protrusion 88 which engages with the second edge 85 is formed to the carriage 4 located far from the platen 2. Moreover, an engaging part 89 which engages with the aforementioned stepped portion 86 is formed at the lower part of this carriage 4.

The first edge 84, second edge 85, pin 87 and protrusion 88 constitute a carriage mounting structure which movably mounts the carriage 4 to the frame 1.

The stepped portion 86 and engaging portion 89 described above form a carriage guiding means which moves the carriage 4 along the platen 2.

Figure 13:
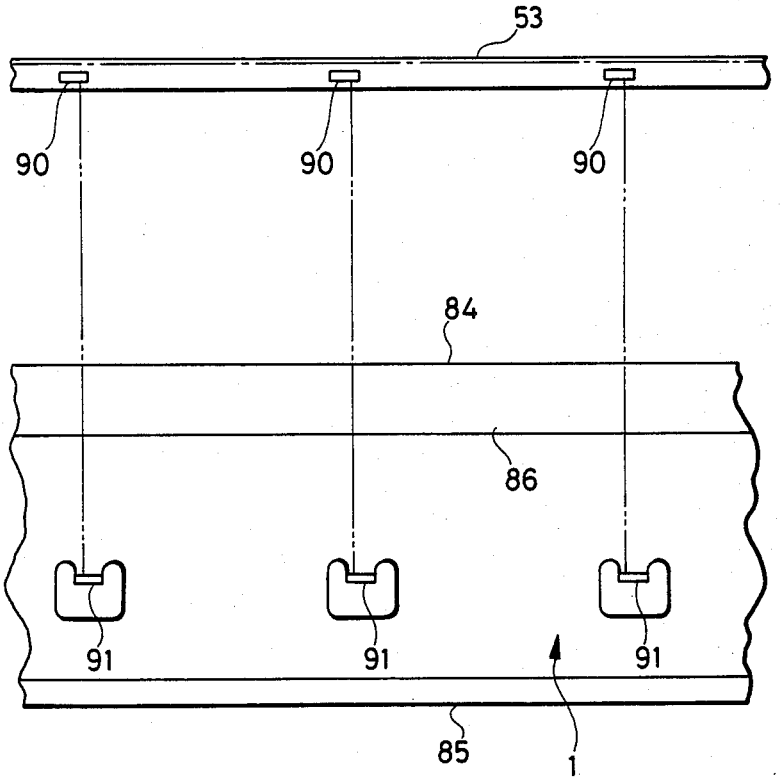
FIG. 13 is a disassembled diagram indicating the mounting structure of the rack gear provided to the embodiment shown in FIG. 1.

FIG. 13 shows a disassembling diagram of the mounting structure of rack gear 53 described above. As shown in FIG. 13, the rear side of rack gear 53 allows formation of a plurality of holes 90 and the frame 1 is provided with a plurality of protrusions namely the erected portions 91 corresponding to the holes 90 of rack gear 53. The rack gear 53 is mounted to the frame 1 by respectively engaging the erecting portions 91 to the holes 90.

With reference to FIGS. 6 10 and FIGS. 15, 16, 18 and 18 described above, the shift mechanism of tape cassette 6, the tape-wind stop mechanism of printing tape 37, the pressurized contact release mechanism of thermal head 5 and mounting mechanism of thermal head 5 to be provided to the embodiment are described below.

Figure 14A:
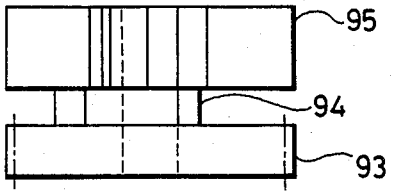
FIG. 14(*a*), (*b*), (*c*) show the restoration cam and pressurized cam provided to the embodiment shown in FIG. 1.
Figure 14B:
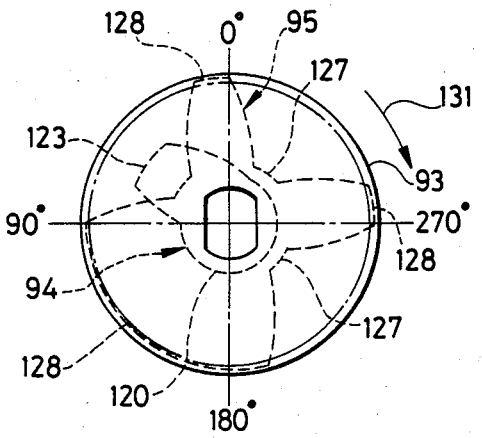
Figure 14C:
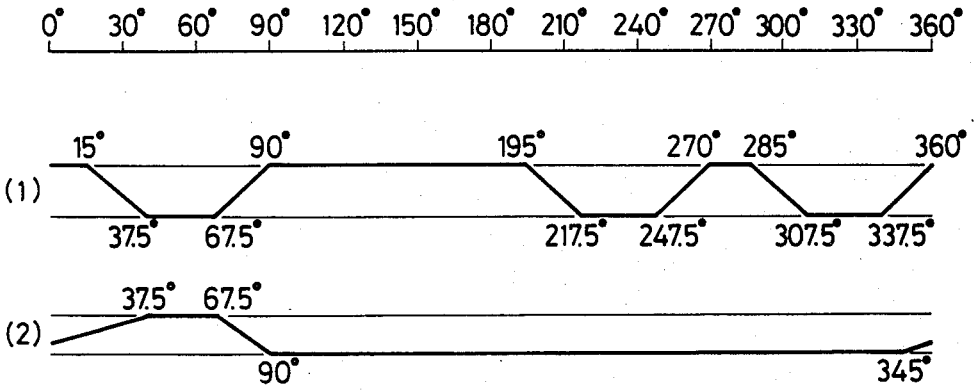
Figure 15A:
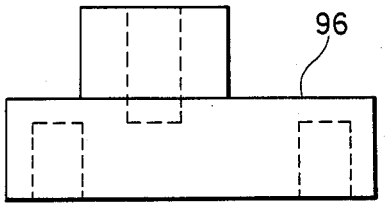
FIG. 15(*a*), (*b*), (*c*) show the tape shift cam provided to the embodiment shown in FIG. 1.
Figure 15B:
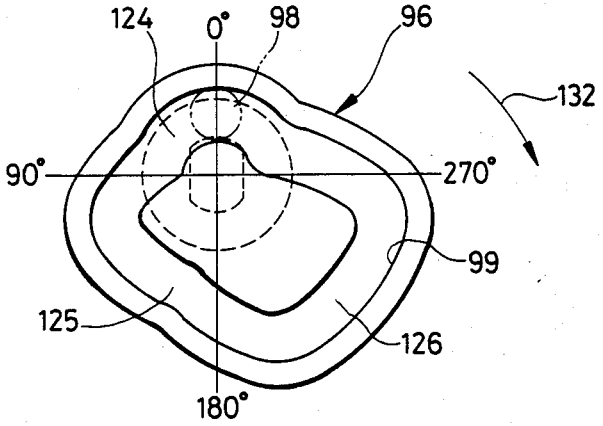
Figure 15C:
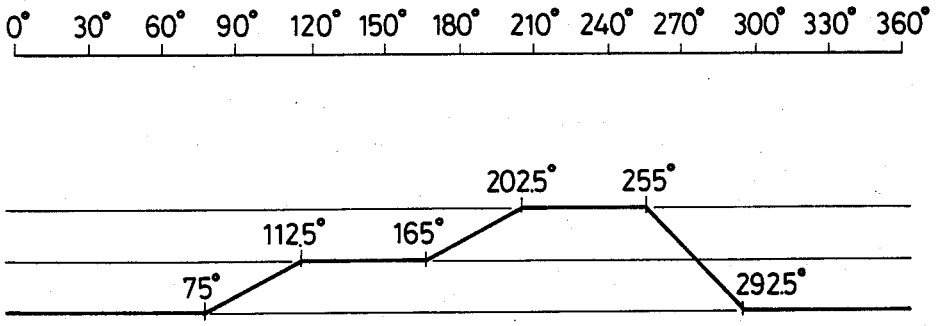
Figure 16A:
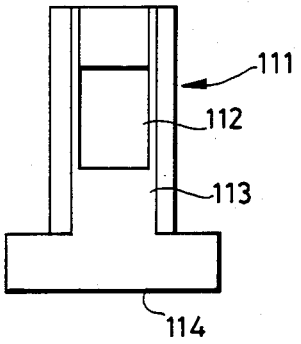
FIG. 16(*a*), (*b*) show the head base provided to the embodiment shown in FIG. 1.
Figure 16B:
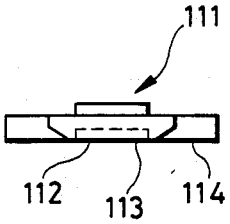

In FIG. 6, 92 is a gear which is loaded to the shaft 7 passing through the carriage 4 and rotates together with this shaft 7. 93 is a gear engaging with the gear 92. 94 is a restoration cam. 95 is a pressurized cam. 96 is a tape shift cam. The gear 93, restoration cam 94 and pressurized cam 95 are integrated as shown in the side elevation of FIG. 14(*a*) and the front elevation of FIG. 14(*b*). The tape shift cam 96 is formed individually from the gear 93 as shown in the side elevation of FIG. 15(*a*) and the front elevation of FIG. 15(*b*). As shown in FIG. 6, an aggregate of these gear 93, restoration cam 94 and pressurized cam 95 and the tape shift cam 96 are integrally and rotatably loaded to the carriage 4, owing to the shaft 97 having the cross-section like an elon9ated circle as shown in FIG. 6. The characteristic of pressurized cam 95 is set, for example, as shown in (1) of FIG. 14(*c*), while the characteristic of restoration cam 94 is set, for example, as shown in (2) of FIG. 14(*c*), and the characteristic of tape shift cam 96 is set, for example, as shown in FIG. 15(*c*). The groove 99 to which the end point of pin 98 loaded to the holding plate 45 is formed to the tape shift cam 96. In FIG. 6, the carriage 4 and the cassette holding plate 45 are separated and the rear side of cassette holding plate 45 is indicated. On the occasion of loading the abovementioned tape cassette 6, the pin 98 is inserted to the groove 99 of the tape shift cam 96, the cassette holding plate 45 is mounted to the carriage 4 in such a way that the bearings 49 and 50 of cassette holding plate 45 are adopted to the holes 51, 52 of the carriage 4 and the tape cassette 6 is loaded to the cassette holding plate 45. Accordingly, the gear 93 rotates due to the rotation of gear 92 caused by rotation of shaft 7. Thereby, the pin 98 moves upward to the intermediate position from the lower position and then to the upper position as described later, the cassette holding plate 45 rotates around the bearings 49, 50 and the level of tape cassette 6 changes. Namely, a cassette shift mechanism which sets the tape cassette 6 to a plurality of levels, for example, three positions in height is constituted with the aforementioned gears 92 and 93, tape shift cam 96, pin 98 and cassette holding plate 45.

Said restoration cam 94 engages with the protrusion 100 formed on the side of the moving body 55 shown in FIG. 10. With rotation of the restoration cam 94, as described later, the moving body 55 moves away from the platen 2, against the force of line spring 61 shown in FIG. 6. Thereby, engagement of transmission gear 54 and rack gear 53 is restored. Namely, the tape-wind stop mechanism of printing tape 37 which restores engagement of transmission gear 54 and rack gear 53 and stops the winding operation of the printing tape 37 is constituted by the gears 92 and 93, restoration cam 94, moving body 55 and line spring 61, as described above.

Figure 17A:
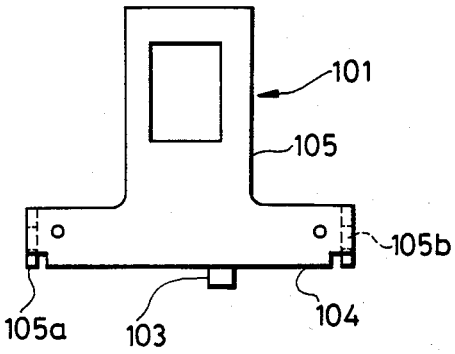
FIG. 17(*a*), (*b*),(*c*) show the lever which is provided to the embodiment shown in FIG. 1 and forms a holding body.
Figure 17B:
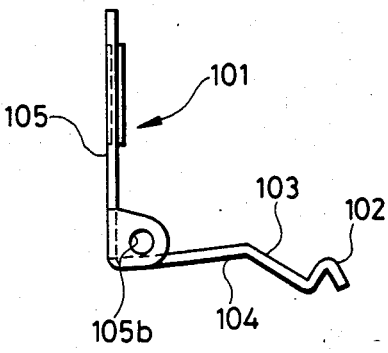
Figure 17C:
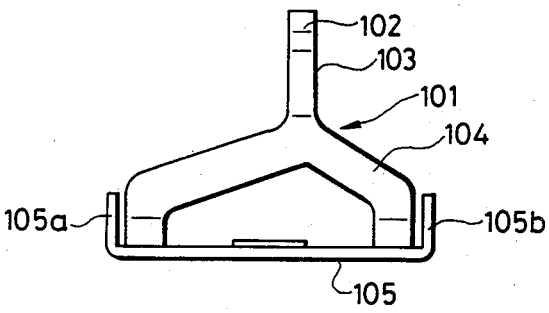
Figure 18A:
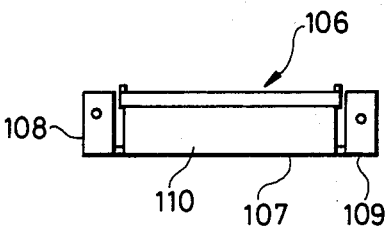
FIG. 18(*a*), (*b*), (*c*) show the member which is provided to the embodiment shown in FIG. 1 and forms the holding body.
Figure 18B:
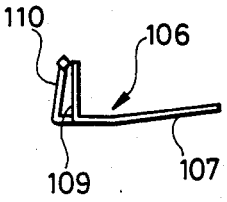
Figure 18C:
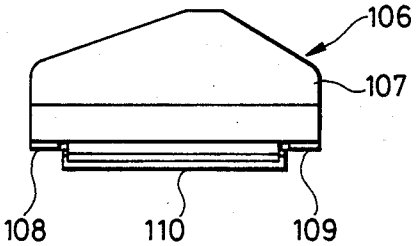

Moreover, as shown in FIG. 10 and FIG. 6, said pressurized cam 95 engages with a lever 101 which is rotatably loaded to the side of lever 101 of the carriage 4. The lever 101 is coupled to the arm 103 having the engaging part 102 being in contact with pressurized cam 95, the bottom part 104 being in contact with such arm 103 and the bottom part 104, as shown in the front elevation of FIG. 17(*a*), side elevation of FIG. 17(*b*) and plan view of FIG. 17(*c*), and is composed of the rising part 105 located in the side of platen 2 and the bearings 105*a* and 105*b*. 106 shown in FIG. 10 is a member loaded to the lever 101 and is composed, as shown in the front elevation of FIG. 18(*a*), side elevation of FIG. 18(*b*) and plan view of FIG. 18(*c*), of the bottom part 107 which is in contact with the lower part of the bottom part 104 of lever 101, two rising portions 108 and 109 which are in contact with the area near both ends of lower part of the rising part 105 of the lever 101 and are fixed to said rising part 105, for example, with screws and the rising part 110 which is located at the front side of center of the lower part of rising part 105 of lever 101 and has elasticity. 111 shown in FIG. 6 is a head base to which the thermal head 5 is loaded. As shown in the front elevation of FIG. 16(*a*) and plan view of FIG. 16(*b*), this head base is composed of the central rising part 113 having the mounting part 112 on which the thermal head 5 is mounted and the the base part 114 which is formed at the lower part of such central rising part 113 and is held by the rising part 110 of said member 106 and the rising part 105 of lever 101. FIG. 7, FIG. 8 and FIG. 9, etc. show the condition where the lever 101, member 106 and head base 111 are assembled. 115 and 116 shown in FIGS. 6 and 10 are pins which are inserted to the bearings 105*a* and 105*b* of lever 101 and the hole provided to the carriage 4 and rotatably support the lever 101. 117 and 118 shown in FIGS. 6 and 7 are springs held respectively by the pins 115 and 116 with the one end being engaged with the carriage 4 while the other end being engaged with the lower part of the rising part 105 of lever 101.

Said lever 101 and member 106 form a holding body which holds the head base 111. Said springs 117 and 118 form an elastic body which causes the head base 111 to energize said holding body to rotate toward to the platen 2. Said head base 111, a the holding body consisting of the lever 101 and member 106, the elastic body consisting of the springs 117 and 118 and pins 115 and 116 form the mounting structure of thermal head 5.

As described later, with rotation of the pressurized cam 95, the rising part 105 of lever 101, the central rising part 113 of head base 111 and the thermal head 5 are erected as shown in FIG. 9, namely the thermal head 5 is pressurized to the platen 2, or as shown by the arrow mark 119, the lever 101 rotates and the head base 111 and thermal head 5 also rotate integrally in the direction of arrow 119. Thereby, the pressurized contact of thermal head 5 to the platen 2 can be restored.

Said gears 92 and 93, pressurized cam 95, lever 101, member 106 and head base 111, etc. form the head pressurization restoration mechanism which pressurizes the thermal head 5 to the platen 2 and restores such pressurization.

Operations of an embodiment constituted as described above are explained below.

First, operations such as (1) carriage driving operation
(2) paper feed operation
(3) printing tape winding operation
(4) printing tape wind stop operation
(5) tape cassette shift operation
(6) thermal head pressurizing and restoration operation are individually described, and then a series of said operations conducted for one basic printing operation is also described.

(1) Carriage driving operation

With rotation of the stepping motor 11 shown in FIG. 1, the worm 10 rotates, followed by rotation of the worm wheel 9 and thereby the cam 8 rotates integrally. When the cam 8 respectively reaches the characteristic ranges indicated in FIG. 2(*c*) as 15°~60°, 135°~150°, and 225°~330°, the lever 13 rotates counterclockwise as shown in FIG. 1(*a*) about the pivot 14. Thereby, the slider 15 engaging with the lever 13 moves to the left of FIG. 1(*a*) and the gear formed at the left side of said slider 15 engages with the gear 17. When the stepping motor 16 rotates, the slider 15 also rotates, followed by rotation of gear 17. Thereby, the gear 19, namely the helical gear 20 also rotates and the helical gear 21, namely the pulley 23 rotates. When the pulley 23 rotates, the metal belt 24 moves and thereby the carriage 4 moves in the right and left directions of FIG. 1(*a*), namely moves along the platen 2.

(2) Paper feed operation When the stepping motor 11 shown in FIG. 11 rotates, the cam 8 also rotates through the worm 10 and worm wheel as described above. Next, the cam 8 respectively reaches the characteristic ranges indicated as 0°~15°, 90°~105°, 180°~195° of FIG. 2(*c*), the lever 13 rotates in the condition shown in FIG. 1(*a*) about the pivot 14, namely rotates clockwise from the condition of driving the carriage. Accordingly, the slider 15 engaging with the lever 13 moves to the right of FIG. 1 and the gear formed at the right side of said slider 15 engages with the gear 18. When the stepping motor 16 rotates, the slider 15 also rotates, followed by rotation of gears 27, namely the gear 28. Thereby, the gear 30 namely the gear 31 rotates, causing the gear 32 to rotate. When the gear 32 rotates, the paper feed shaft 29 rotates, and the sprocket 33 rotates. Thereby, the recording paper wound around the platen 2 is shifted a specified quantity, for example, as much as one line, in the direction orthogonal to the moving direction of the carriage 4.

(3) Printing tape winding operation

Figure 19A:
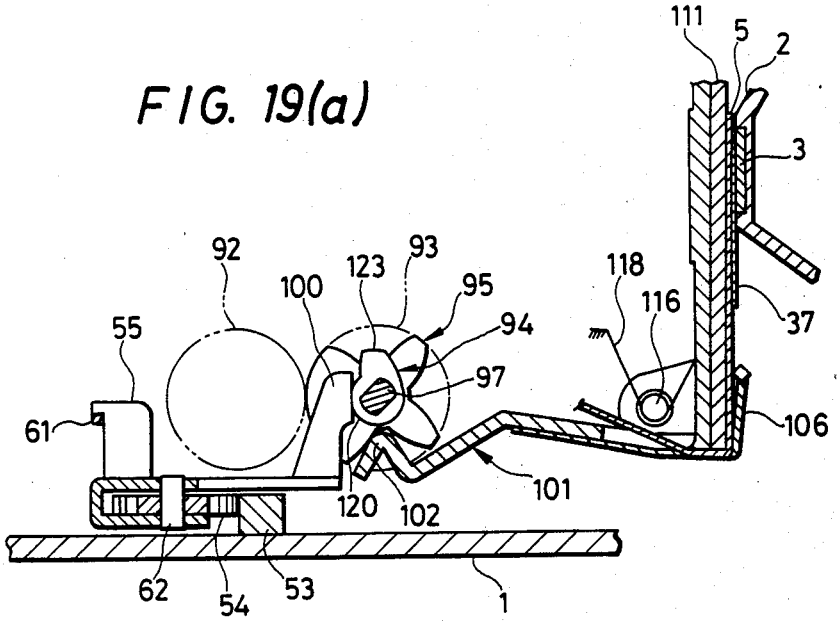
FIG. 19(*a*) shows operation of the printing tape winding mechanism provided to the embodiment shown in FIG. 1.
Figure 19B:
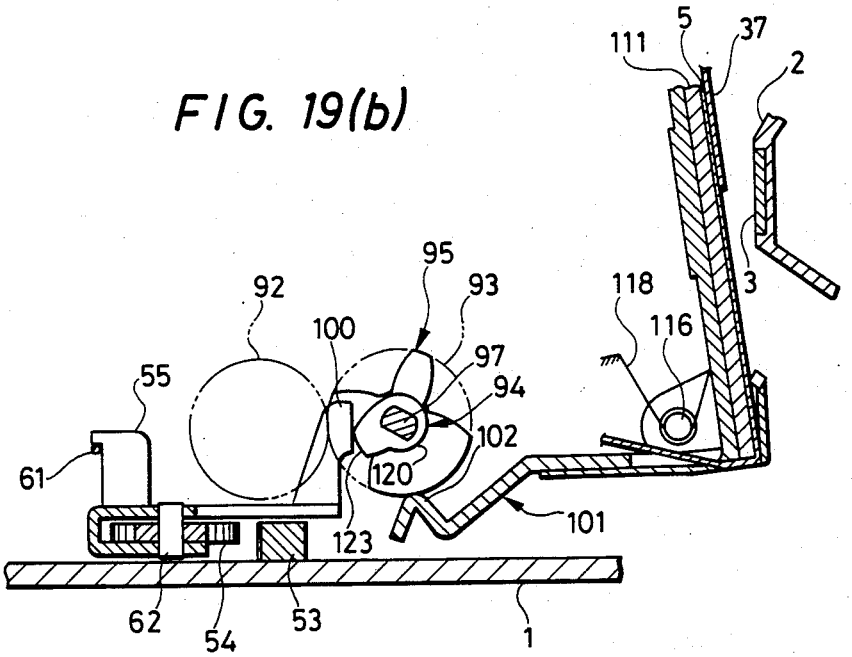

With rotation of the stepping motor 11 shown in FIG. 1, the worm 10 rotates, followed by rotation of the worm wheel 9, causing the shaft 7 extending through the carriage 4 to rotate. Thereby, the gear 92 rotates, causing the gear 93 to rotate and the restoration cam 94 also rotates integrally with the gear 93. When said restoration cam 94 engages with the protrusion 100 of moving body 55 shown in FIG. 10 in the characteristic range (2) of restoration cam 94 indicated as 90°~345° of FIG. 14(*c*), said protrusion 100 engages with a small diameter part 120 of restoration cam 94, as shown in FIG. 19(*a*), with am energizing force of the line spring 61 shown in FIG. 6. Accordingly, the moving body 55 is located nearer to the platen 2 and the transmission gear 54 engages with the rack gear 53. In such, a condition, when the carriage 4 moves, for example, to the right of FIG. 1(*a*), the pivot 62 of transmission gear 54 relatively moves to the left of FIG. 1(*a*) in the elongated hole 63 of the moving body 55, namely up to the condition indicated in FIG. 10, through to an engaging force by the rack gear 53. Thereby, the transmission gear 54 engages with the tape winding gear 65. With movement of said carriage 4, the tape winding gear 65 rotates through the transmission gear 54 and the first pin gear 67 rotates clockwise integrally with said tape winding gear 65. When the first pin gear 67 rotates, the second pin gear 71 rotates counterclockwise, followed by the counterclockwise rotation in FIG. 4 of the bobbin shown in FIG. 4. Thereby, the core 42 shown in FIG. 3 engaging with the bobbin 47 rotates counterclockwise. The printing tape 37 is thus wound in the direction of arrow 121 of FIG. 3.

When the carriage 4 moves to the left of FIG. 1(*a*) under the condition that the transmission gear 54 is engaging with the rack gear 53 as described above, the pivot 62 of transmission gear 54 relatively moves to the right of FIG. 1(*a*) within the elongated hole 63 of the moving body 55, namely to the left of FIG. 10. Thereby, the transmission gear 54 engages with the tape winding gear 64. With movement of the carriage 4, the tape winding gear 64 rotates through the transmission gear 54 and the first pin gear 66 shown in FIG. 6 rotates counterclockwise integrally with rotation of the tape winding gear. With rotation of the first pin gear 66, the second pin gear 70 rotates clockwise, followed by the clockwise rotation of the bobbin 46 as shown in FIG. 4. Thereby, the core 41 shown in FIG. 3 engaging with the bobbin 46 also rotates clockwise. Thus, the printing tape 37 is wound in the direction of arrow 122 shown in FIG. 3.

Namely, the printing tape 37 shown in FIG. 3 is released and wound respectively in the directions of arrow 121 or 122 for the quantity corresponding to the movement of the carriage 4, in accordance with the movement to the right or left in the FIG. 1(*a*) of the carriage 4.

(4) Printing tape wind-stop operation

When the stepping motor 11 shown in FIG. 1 rotates, the shaft 7 rotates through the worm 10 and worm wheel 9 and moreover the restoration cam rotates through the gears 92 and 93. When said restoration cam 94 engages with the protrusion 100 of moving body 55 of FIG. 10 while the restoration cam 94 is in the characteristic range (2) indicated as 37.5°~67.5° of FIG. 14(*c*), said protrusion 100 engages with the large diameter portion 123 of restoration cam 94 as shown in FIG. 19(*b*), namely the moving body 55 is located away from the platen 2 against an energizing force of the line spring 61. Thereby, the transmission gear 54 separates from the rack gear 53, cancelling engagement with the rack gear 53. Accordingly, the tape winding gears 64 and 65 no longer rotate even when the carriage 4 moves, and the first pin gears 66 and 67, second pin gears 70 and 71, bobbins 46 and 47, cores 41 and 42 do not rotate and the printing tape 37 is kept in a ready condition.

(5) Tape cassette shift operation

Figure 20A:
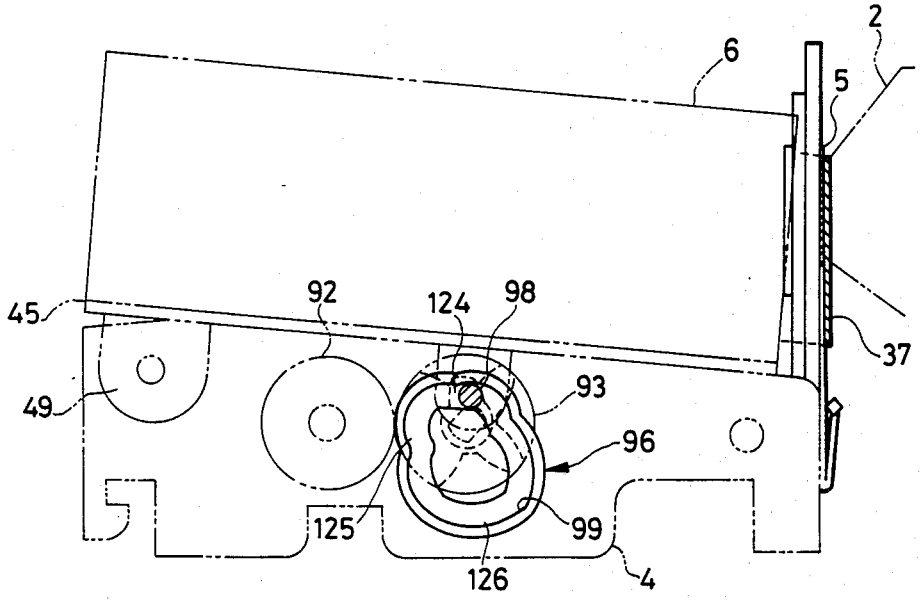
FIG. 20(*a*), (*b*), (*c*) show operation of the tape cassette shift mechanism provided to the embodiment shown in FIG. 1.
Figure 20B:
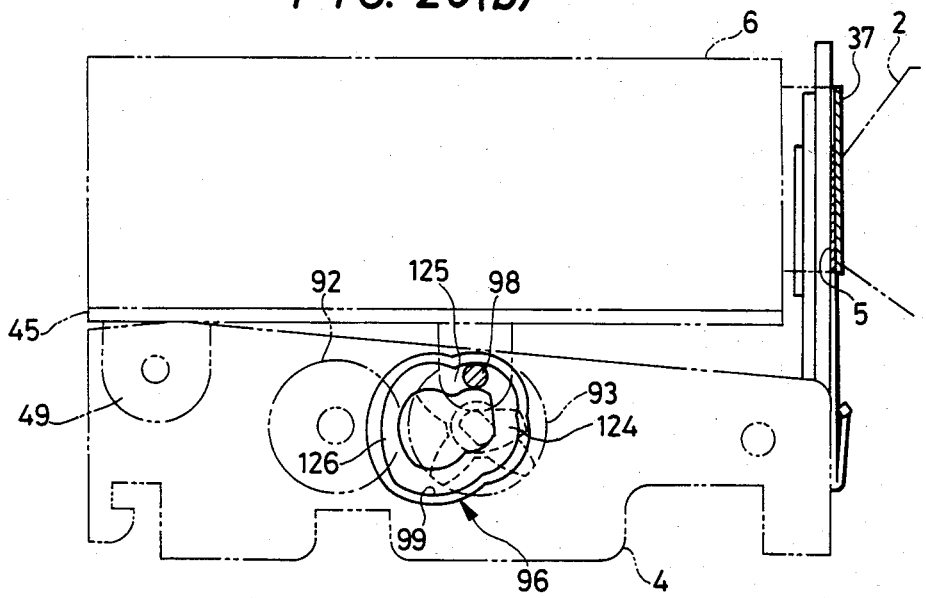
Figure 20C:
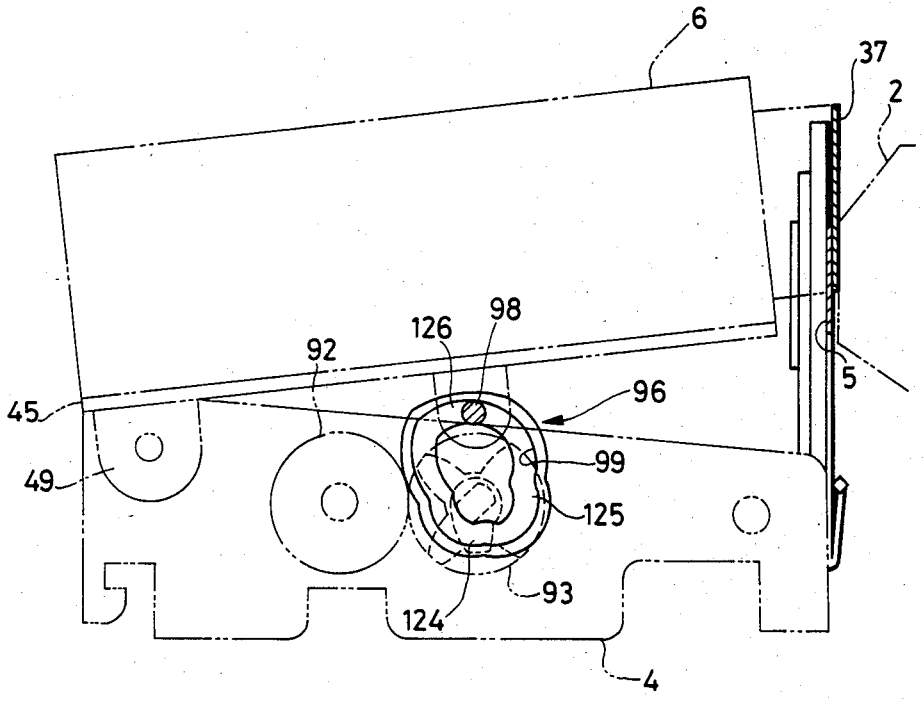

When the stepping motor 11 shown in FIG. 1 rotates under the condition, as shown in FIG. 20(*a*), that the cassette holding plate 45 is loaded to the carriage 4, the pin 98 is inserted into the groove 99 of tape shift cam 96 and the tape cassette 6 is loaded on the cassette holding plate 45, the shaft 7 rotates through the worm 10 and worm wheel 9 and the tape shift cam 96 rotates through the gears 92 and 93.

When the tape shift cam 96 is in the characteristic range indicated as 0°~75° of FIG. 15(*c*), the pin 98 is located at the position 124 of the groove 99 of FIG. 15(*b*), namely is placed under the condition of FIG. 20(*a*). Thereby, both cassette holding plate 45 and tape cassette 6 are located at the lower position as indicated in the figure. At this time, the printing region 38 located at the upper area in FIG. 12 of the printing tape 37 accommodated within the tape cassette 6 is opposed to the thermal head 5 and the printing can be done in this case utilizing such printing region 38 of the printing tape 37.

When the tape shift cam 96 is in the characteristic range indicated as 112.5°~165° in FIG. 15(*c*), the pin 98 is located at the position 125 of groove 99 in FIG. 15(*b*), namely in the condition of FIG. 20(*b*). Thereby, both cassette holding plate 45 and tape cassette 6 are located at the intermediate area. In this case, the printing region 39 located at the intermediate area in of the printing tape 37 in the tape cassette 6 shown in FIG. 12 is opposed to the thermal head 5 and thereby the printing can be done utilizing such printing region 39.

When the tape shift cam 96 is in the characteristic range indicated as 202.5°~255° of FIG. 15(*c*), the pin 98 is located at the position 126 of groove 96 of FIG. 15(*b*), namely in the condition of FIG. 20(*c*). Thereby, both cassette holding plate 45 and tape cassette 6 are located at the upper area. At this time, the printing region 40 located at the lower part of the printing tape 37 accommodated in the tape cassette 6 shown in FIG. 12 is opposed to the thermal head 5 and the printing can be done utilizing such printing region 40.

(6) Thermal head pressurizing and restoration operation

When the stepping motor 11 shown in FIG. 1 rotates, the shaft 7 rotates through the worm 10 and worm wheel 9. Moreover, the pressurized cam 95 rotates through the gears 92 and 93. When the pressurized cam 95 is in the characteristic range (1) indicated as 37.5°~67.5°, 217.5°~247.5°, 307.5°~337.5° of FIG.

Figure 21A:
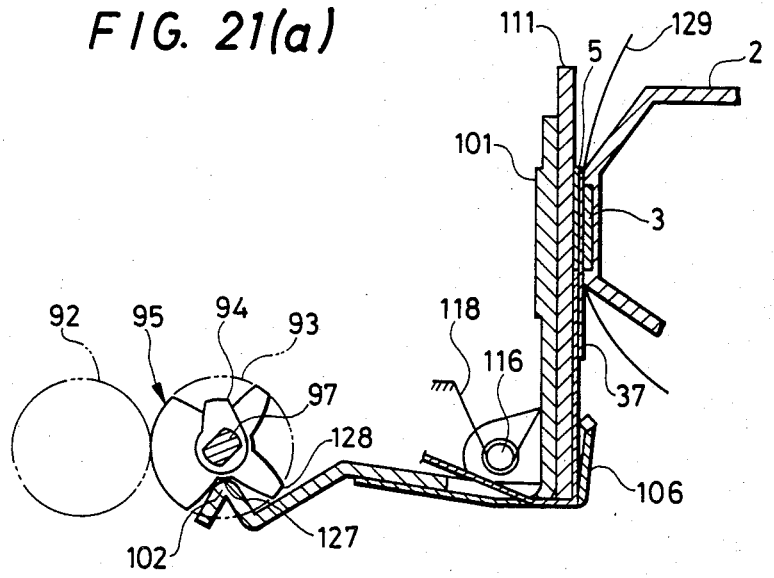
FIG. 21(*a*),(*b*) show operation of the thermal head pressurizing and unpressurizing mechanism provided to the embodiment shown in FIG. 1.
Figure 21B:
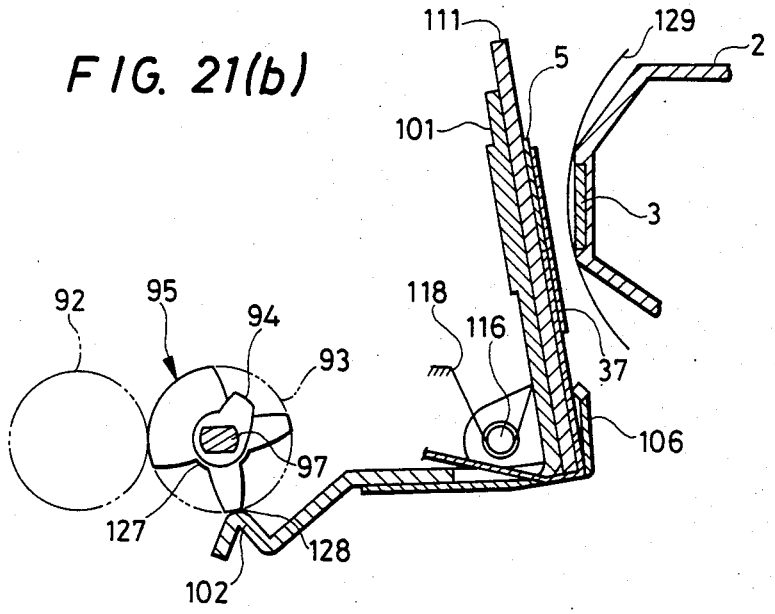

14(*c*) and said pressurized cam 95 engages with the engaging part 102 of the lever 101, said engaging part 102 engages, as shown in FIG. 21(*a*), with the small diameter part 127 of the pressurized cam 95. Namely, the lever 101 rotates about the pins 115, 116 with a force of the springs 117, 118 in such a direction as becoming nearer to the platen 2. Moreover, the head base 111 and thermal head 5 rotate integrally with the lever 101. Thereby, the thermal head 5 causes the printing tape 37 and recording paper 129 to be pressurizingly in contact with the platen 2. When power is supplied to the thermal head 5 under this condition, the thermally fusible material of printing tape 37 melts and data is printed on the recording paper 129. On the rotation of the pressurized cam 95, when said pressurized cam 95 engages with the engaging part 102 of lever 101 while the pressurized cam is in the characteristic range (1) indicated as 0°~15°, 90°~195°, 270°~285° of FIG. 14(*c*), said engaging part 102 engages with the large diameter part 128 of the pressurized cam 95 as indicated in FIG. 21(*b*), namely, the lever 101 rotates counterclockwise from the condition shown in FIG. 21(*a*) about the pins 115 and 116 against a force of the springs 117 and 118, the head base 111 and thermal head 5 also rotate integrally with the lever 101 away from the platen 2, thereby the pressurized contact of thermal head 5 to the platen 2 is released.

A series of operations performed for a single basic printing operation will then be described below.

In the case of this embodiment, it is supposed that a feed quantity of printing tape 37 corresponds to a quantity of movement in one direction movement of the carriage 4, printing in three stages for the width direction of the printing tape 37 is possible, and the operations 1~7 listed below are sequentially performed as the basic printing operations.

1 Paper feed

The carriage 4 stops, the tape cassette 6 is held at the lower position, the printing tape 37 is held at the winding ready condition, the thermal head 5 is kept at the pressurized contact restoration condition, and the recording paper is fed.

Namely, the carriage 4 loading the tape cassette 6 is set to the specified printing start position at the left end side shown in FIG. 1(*a*). When the stepping motor 11 is driven under this condition, the cam 8 rotates through the worm 10 and worm wheel 9. While the cam 8 rotates for the characteristic range of 0°~15° shown in FIG. 2(*c*), namely the cam rotates up to 15°, the slider 15 engages with gear 18 through the lever 13. In such a condition, when the stepping motor 16 is driven, the slider 15 rotates and thereby the gears 18, 27, 28, 30, 31 and 32 rotate, followed by rotation of the paper feed shaft 29 and sprocket 33, and the recording paper (not shown) is fed, for example, as much as one line in the direction of arrow 130 of FIG. 1(*a*).

While said cam 8 is rotating for 15°, the shaft 7 rotates for 15° integrally with the cam 8. Thereby, the restoration cam 94 and pressurized cam 95 rotate in the direction of arrow 131 as shown in FIG. 14(*b*), followed by rotation of the tape shift cam 96 in the direction of arrow 132 as shown in FIG. 15(*b*). Accordingly the tape shift cam 96 engages with the small diameter part located at the lower left part of restoration cam 94 shown in FIG. 14(*b*) and the protrusion 100 of the moving body 55 shown in FIG. 10. Thereby, the rack gear 53 engages with the transmission gear 54 as shown in FIG. 19(*a*) and the printing tape 37 is set in the winding ready condition.

In addition, the lower part of pressurized cam 95 shown in FIG. 14(*b*) engages with the engaging part 102 of the lever 101. Thereby, head base 111 and thermal head 5 are separated from the platen 2 and are set in the pressurized contact released condition. Although the rotating condition of pressurized cam 95 is different, such pressurized contact released condition is indicated in FIG. 21(*b*). The pin 98 loaded to the cassette holding plate 45 is located at the position 124 of the tape shift cam 96. Thereby, the tape cassette 6 on the cassette holding plate 45 is located at the lower part as shown in FIG. 20(*a*) and the printing region of upper part of printing tape 37 shown in FIG. 12 can be used for printing.

2 Carriage movement in the right, first printing

The tape cassette 6 is held at the lower part, the printing tape 37 is held in the winding ready condition, the thermal head 5 is kept in the pressurized contact condition, the carriage 4 moves to the right as shown in FIG. 1(*a*) and the first printing operation is carried out using the upper printing region 38 of the printing tape 37 shown in FIG. 12.

Namely, when the stepping motor 11 is further driven from the condition 1 and thereby the cam 8 rotates up to 45°~60°, the lever 13 rotates and the slider 15 engages with the gear 17. In such a condition, when the stepping motor 16 rotates, the slider 15 rotates and thereby the gear 19, helical gears 20 and 21, and pulley 23 rotate. The metal belt 24 thus moves and the carriage 4 moves to the right of FIG. 1(*a*), namely moves to the right end from the left end of frame 1.

While the cam 8 rotates up to 60° as described above, the shaft 7 rotates up to 60° integrally with such cam 8. Thereby, the restoration cam 94 and pressurized cam 95 further rotate in the direction of arrow 131 as shown in FIG. 14(*b*) and the tape shift cam 96 also rotates further in the direction of arrow 132 shown in FIG. 15(*b*). Accordingly, engagement between the small diameter part 120 of restoration cam 94 and protrusion 100 of moving body 55 shown in FIG. 14(*b*) is kept, the transmission gear 54 engages with the tape winding gear 65 with the movement of carriage 4, rotation of transmission gear 54 is transmitted to the core 42 through the tape winding gear 65, first pin gear 67, second pin gear 71 and bobbin 47. Thereby, the printing tape 37 within the tape cassette 6 is wound in the direction of arrow 121 as shown in FIG. 3. Moreover, the small diameter part 127 at the shown at the lower right section of the pressurized cam 95 engages with the engaging part 102 of the lever 101 as shown in FIG. 21(*a*). Thereby, both head base 111 and thermal head 5 are pressurized to the platen 2. Meanwhile, the pin 98 of the cassette holding plate 45 is continuously held at the position 124 of the tape shift cam 96 and the tape cassette 6 is kept at the lower level.

In other words, while the cam 8 rotates up to 60°, the tape cassette 6 is held at the lower part as shown in FIG. 20(*a*), the thermal head 5 is held in the pressurized condition, the carriage 4 moves to the right end from the left end of the frame 1 shown in FIG. 1(*a*) and the printing tape 37 is wound in the direction of arrow 121 shown in FIG. 3. Accordingly, when electrical power is supplied to the thermal head 5 as specified for starting the movement of carriage 4, the printing can be done utilizing the printing region 38 at the upper part of the printing tape 37 as shown in FIG. 12.

3 Paper feed

The carriage 4 stops, the tape cassette 6 is shifted to the intermediate part to the lower part, the printing tape 37 is kept at the winding ready condition, the thermal head 5 is kept at the pressurized contact released condition and the paper feed is executed.

Namely, when the stepping motor 11 is driven further from the condition of 2 and thereby the cam 8 rotates up to 90°~105°, the slider 15 engages with the gear 18 through the lever 13 and the recording paper is sent as much as one line in the direction of arrow 130 of FIG. 1(*a*) as described above. During this operation, the shaft 7 rotates up to 105° integrally with the cam 8, the restoration cam 94 and pressurized cam 95 further rotate in the direction of arrow 131 of FIG. 14(*b*) and the tape shift cam 96 further rotates in the direction of arrow 132 as shown in FIG. 15(*b*). Accordingly, engagement between the small diameter part 120 of restoration cam 94 shown in FIG. 14(*b*) and the protrusion 100 of moving body 55 is kept continuously and the rack gear 53 is continuously engaged with the transmission gear 54. The pressurized cam 95 is kept in the unpressurized condition which allows feed of recording paper through engagement between the large diameter part 128 shown at the right side of FIG. 14(*b*) and the engaging part 102 of the lever 101. The pin 98 of the cassette holding plate 45 is in the course of relative movement within the groove 99 of tape shift cam 96 from the position 124 to the position 125. Thereby, the cassette holding plate 45 and tape cassette 6 rotate counterclockwise in the figure about the bearings 49 and 50 from the condition shown in FIG. 20(*a*). Thereby, the printing region 39 located at the intermediate part of printing tape 37 shown in FIG. 12 is placed facing to the thermal head 5.

4 Carriage movement to the left, second printing

The tape cassette 6 is kept at the intermediate part, the printing tape 37 is kept at the winding ready condition, the thermal head 5 is pressurized, the carriage 4 moves to the left of FIG. 1(*a*) and the second printing operation is carried out utilizing the intermediate printing region 39 of the printing tape 37 shown in FIG. 12.

Namely, when the stepping motor 11 is further driven from the condition 3 described above and thereby the cam 8 rotates up to 135°~150°, the slider 15 engages with the gear 17 through the lever 13 and the carriage 4 moves to the extreme left side from the extreme right side of the frame of FIG. 1(*a*). During this period, the shaft 7 also rotates up to 150° integrally with the cam 8, both restoration cam 94 and pressurized cam 95 further rotate in the direction of arrow 131 shown in FIG. 14(*b*) and the tape shift cam 96 further rotates in the direction of arrow 132 shown in FIG. 15(*b*). Accordingly, engagement between the small diamter 120 of restoration cam 94 and the protrusion 100 of moving body 55 shown in FIG. 14(*b*) is held continuously, the transmission gear 54 engages with the tape winding gear 64, with movement of carriage 4 in the left side of FIG. 1(*a*), rotation of the transmission gear 54 is transmitted to the core 41 shown in FIG. 3 through the the tape winding gear 64, first pin gear 66, second pn gear 70 and bobbin 46. Thereby, the printing tape 37 is wound in the direction of arrow 122 as shown in FIG. 3. Namely, the printing tape 37 is wound in the same amount but in the opposite direction to the tape winding while the cam 8 rotates up to 45° to 60° described previously. The small diameter part 127 at the upper right side in FIG. 14(*b*) of the pressurized cam 95 enageges with the engaging part 102 of the lever 101. Accordingly, the thermal head 5 is pressurized. The pin 98 of cassette holding plate 45 is continuously held at the position 125 of tape shift cam 96 and the tape cassette 6 is kept at the intermediate part as shown in FIG. 20(*b*).

Namely, while the cam 8 rotates up to 150°, the tape cassette 6 is kept at the intermediate part shown in FIG. 20(*b*), the thermal head 5 is pressurized, the carriage 4 moves to the extreme left side from the extreme right side of the frame 1 of FIG. 1(*a*) and the printing tape 37 is wound in the direction of arrow 122 of FIG. 3. Accordingly, during this period, when electrical power is applied to the thermal head 5, printing is carried out utilizing the printing region 39 located at the intermediate part of printing tape 37 shown in FIG. 12.

5 Paper feed

The carriage 4 stops, the tape cassette 6 is shifted to the upper level from the intermediate level, the printing tape is kept in the winding ready condition, the thermal head 5 is kept in the unpressurized condition and paper feed is carried out.

Namely, when the stepping motor 11 is further driven from the condition 4 and thereby the cam 8 rotates up to 180°~195°, the slider 15 engages with the gear 8 through the lever 13 and the recording paper is sent as much as one line in the direction of arrow 130 of FIG. 1(*a*). During this period, shaft 7 rotates up to 195° integrally with the cam 8, both restoration cam 94 and pressurized cam 95 rotate in the direction of arrow 131 of FIG. 14(*b*) and the tape shift cam 96 further rotates in the direction of arrow 132 of FIG. 15(*b*). Thereby, engagement between the smaller diameter part 120 of restoration cam 94 shown in FIG. 14(*b*) and the protrusion 100 of the moving body 55 is kept continuously and the rack gear 53 is continuously engaged with the transmission gear 54. The large diameter part 128 at the upper right part of pressurized cam 9 of FIG. 14(*b*) engages with the engaging part 102 of the lever 101 and accordingly the unpressurized condition which allows feeding of the recording paper is kept. Moreover, the pin 98 of cassette holding plate 45 is in the course of relative movement within the groove 99 of the tape shift cam 96 from the position 125 to the position 126. Thereby, both cassette holding plate 45 and tape cassette 6 rotate counterclockwise about the bearings 49 and 50 from the condition of FIG. 20(*b*) and the printing region 39 located at the lower level of the printing tape 37 of FIG. 12 is placed facing to the thermal head 5.

6 Carriage movement to the right, third printing

The tape cassette 6 is kept at the upper level, the printing tape 37 is kept at the winding ready condition, the thermal head 5 is pressurized, the carriage 4 moves to the right of FIG. 1(*a*) and the third printing is carried out utilizing the printing region 40 of the lower part of printing tape 37.

Namely, when the stepping motor 11 is further driven from the condition 5 and the cam 8 rotates up to 225° 330°, the slider 15 engages with the gear 17 through the lever 13. Thereby, first, the carriage 4 moves to the right end from the left end of the frame 1 as in the case described above. Thereafter, the carriage 4 returns and moves to the left end from the right end. While the carriage 4 moves to the right end as described above, engagement between the smaller diameter part 120 of the restoration cam 94 shown in FIG. 14(*b*) and the protrusion 100 of the moving body 55 is kept continuously, the transmission gear 54 engages with the tape winding gear 65 with movement of cariage 4 to the right, rotation of transmission gear 54 is transmitted to the core 42 through the tape winding gear 65, first pin gear 67, second pin gear 71 and bobbin 47. Thereby, the printing tape 37 of tape cassette 6 is wound in the direction of arrow 121 of FIG. 3. The smaller diameter part 127 of upper left part of figure of the pressurized cam 95 shown in FIG. 14(*b*) engages with the engaging part 102 of the lever 101 and thereby the thermal head 5 is pressurized. The pin 98 of cassette holding plate 45 is continuously kept at the position 126 of tape shift cam 96 shown in FIG. 15(*b*) and the tape cassette 6 is kept at the upper position of FIG. 20(*c*).

In other words, while the carriage 4 moves to the right of FIG. 1(*a*) during rotation of cam 8 up to 225° 330°, the tape cassette 6 is kept at the upper position shown in FIG. 20(*c*), the thermal head 5 is pressurized, and the printing tape 37 is wound in the direction of arrow 121 of FIG. 3. Accordingly, when elecrical power is supplied to the thermal head 5, the printing is carried out utilizing the printing region 40 located at the lower part of printing tape 37 shown in FIG. 12. Upon completion of this printing, all of the printing regions 38, 39 and 40 at the upper part, intermediate part and lower part of the printing tape 37 have been used in three strokes of movement of the carriage 4.

7 Carriage movement to the left, stop of printing

The tape cassette 6 is shifted to the lower position from the upper position, the printing tape 37 is kept to the wind-stop condition, the thermal head 5 is unpressurized and the carriage 4 moves to the left of FIG. 1(*a*). During this period, printing is not carried out.

While the carriage 4 moves to the left namely, it returns after the end of movement to the right and then moves to the left end from the right end of the frame 1 of FIG. 1(*a*) during rotation of cam 8 up to 225°~330°, the larger diameter part 123 of the restoration cam 94 shown in FIG. 14(*b*) engages with the protrusion 100 of the moving body 55 as shown in FIG. 19(*b*), engagement between rack gear 53 and transmission gear 54 is cancelled and thereby the printing tape 37 is kept at the wind-stop condition. Moreover, the larger diameter part 128 at the lower left in the figure of pressurized cam 95 shown in FIG. 14(*b*) engages with the engaging part 102 of lever 101 and thereby the thermal head 5 is unpressurized. The pin 98 of cassette holding plate 45 is in the course of relative movement of the groove 99 of tape shift cam 96 from the position 126 to the position 124. Thereby, both cassette holding plate 45 and tape cassette 6 rotate clockwise about the bearings 49 and 50 f rom the condition shown in FIG. 20(*c*) and thereafter these return to the initial condition shown in FIG. 20(*a*).

Namely, while the carriage 4 moves to the left of FIG. 1(*a*) during rotation of cam 8 up to 225°~330°, the tape cassette 6 is lowered to the lower position shown in FIG. 20(*a*) from the upper position shown in FIG. 20(*c*), the thermal head 5 is kept at the unpressurized condition and the printing tape 37 is kept at the wind-stop condition. Accordingly, during this period, the printing is not conducted.

Thereafter, the above operations from 1 to 7 are repeated for subsequent printing operations.

In such an embodiment constituted as described above, the cassette shift mechanism, head pressuring and unpressurizing mechanism and tape wind-stop mechanism operate by rotation of shaft 7. During a double reciprocation (four strokes) of the carriage, printing is carried out in the three printing regions 38, 39 and 40 of upper and intermediate and lower positions in the width direction of printing tape 37, namely printing can be done three times within the range of feeding quantity of printing tape 37 corresponding to the one-way movement of carriage 4. Accordingly the total width of printing tape 37 can be used for printing and the quantity of printing tape 37 used for printing can be minimized. Moreover, since the quantity of printing by a single printing tape 37 accommodated in the tape cassette 6 can be improved up to 1.5~3 times the quantity of printing in the conventional printer, the replacement frequency of tape cassette 6 can be minimized, thereby improving the printing efficiency. Since printing occurs during three of the four strokes of the carriage 4, the printing speed is improved up to 1.5 times the speed of conventional printer, thus improving the printing efficiency.

In this embodiment, moreover, since the winding mechanism of printing tape 37 comprises respectively a pair of first pin gears 66 and 67, second pin gears 70 and 71, bobbins 46 and 47, cores 41 and 42, and clutch mechanisms 72 and 73, the printing tape 37 can be sent in such a direction as the tape 37 is wound by the core 4 or 42 in accordance with the moving distance of carriage 41 respectively when the carriage 4 moves to the right or left of the frame 1 as shown in FIG. 1(*a*), and the reversible rotation of printing tape 37 can be realized very easily.

Particularly in this embodiment, since the winding mechanism of printing tape 37 is formed as the mechanism which transmits the rotation of transmission gear 54 which is engaging with the rack gear 53 through the engagement between the first pin gears 66, 67 and the second pin gears 70, 71 as a rotating force for winding the printing tape 37, deviation in engaging position at the tooth end between the second pin gears 70 and 71 loaded to the cassette holding plate 45 and the first pin gears 66 and 67 due to the shift operation of the cassette holding plate 45 to the intermediate position from the lower position and to the upper position from the intermediate position is suppressed in such a degree as not giving the effect on transmission of a rotating force. Namely, even when the cassette holding plate 45 is placed to any position of the lower, intermediate and upper positions, reliable engaging relation can be obtained between the first pin gears 66, 67 and the second pin gears 70, 71 and the printing tape 37 can be fed surely corresponding to the movement of carriage 4.

Moreover, in this embodiment, since the printing tape 37 winding mechanism is capable of transmitting a rotating force given to the second pin gears 70 and 71 through the clutch mechanisms 72, 73 to the bobbins 46 and 47, if an excessive rotating force is given to the second pin gears 70 and 71, said rotating force is not transmitted to the bobbins 46 and 47 and accordingly breakdown of printing tape 37 due to such an excessive rotating force can be surely prevented.

Further in this embodiment, since the winding mechanism of printing tape 37 is so constituted that a pair of bobbins 46, 47 loaded to the cassette holding plate 45 and a pair of cores 41, 42 provided within the tape cassette 6 are related in such a manner that the bobbins 46, 47 having the outline like a cross are inserted into the cross-shaped holes formed to the cores 41 and 42 and the cores 41 and 42 are integrally rotated with the rotation of bobbins 46 and 47, any deviation in rotation between the bobbins 46, 47 and cores 41, 42 can be prevented and a rotating force given to the bobbins 46, 47 can be transmitted to the cores 41, 42 with high accuracy.

Further in the present embodiment, since the tape cassette shift mechanism comprises the tape shift cam 96 which rotates with rotation of the shaft 7 and is capable of rotating the cassette holding plate 45 through the pin 98 in accordance with rotation of the tape shift cam 96, the tape cassette 6 on the cassette holding plate 45 can be shifted with high accuracy to the lower, intermediate and upper positions in accordance with the characteristic of tape shift cam 96 and can be held at the adequate position, and the respective printing regions 38, 39, 40 of the printing tape 37 within the tape cassette 6 can be accurately placed facing to the thermal head 5.

Moreover, in this embodiment, since the printing tape wind-stop mechanism has a restoration cam 94 which rotates with rotation of the shaft 7 and is capable of cancelling the engagement between the transmission gear 54 and rack gear 53 through the moving body 55 in accordance with rotation of restoration cam 94, the printing tape winding operation can be stopped accurately in accordance with the characteristic of restoration cam 94 and such wind-stop operation of printing tape 37 can be realized with a reduced number of parts.

Further in this embodiment, since the thermal head pressurizing and unpressurizing mechanism comprises a pressurized cam 95 which rotates with rotation of the shaft 7 and is capable of rotating the lever 101 in accordance with rotation of pressurized cam 95 and pressurizing the thermal head 5 loaded to the head base 111 or unpressurizing it to/from the platen 2, the pressurizing and unpressurizing of thermal head 5 can be changed accurately in accordance with the characteristic of pressurized cam 95 and such operation can be realized with a reduced number of parts.

Also in this embodiment, with rotating operation of shaft 7, the tape shift cam 96 forming the cassette shift mechanism, restoration cam 94 forming the wind-stop mechanism of printing tape 37 and pressurized cam 95 forming the pressurizing and unpressurizing mechanism of thermal head 5 rotate, and since these tape shift cam 96, restoration cam 94 and pressurized cam 95 are rotated integrally with the shaft 97, the shift operation of tape cassette 6, pressurizing and unpressurizing operation of thermal head 5 and wind-stop operation of printing tape 37 can be started in the desired same timing in conjunction with the rotation of shaft, these operations can be realized with minimum number of parts and thereby manufacturing cost can be minimized.

In the present embodiment, since the mounting structure of cariage 4 is composed of the first edge 84 and second edge 85 formed on the frame 1, protrusion 88 which is formed on the carriage 4 and engages with the second edge 85 and the pin 87 which engages with the first edge 84 and is loaded to the carriage 4, the carriage 4 can be movably mounted to the frame 1 with minimum number of parts and thereby light weight and compact structure can be obtained.

In this invention, moreover, since a guiding means of carriage 4 is constituted with the stepped part 86 formed to the frame 1 and the engaging part 89 formed to the carriage 4, the structure can be simplified and manufactured very easily.

In this invention, since the mounting structure of rack gear 53 is mounted to the frame 1 by engaging a plurality of protrusions, namely the erected portions 91 formed to the frame 1 with the holes 90 formed to the rack gear 53, the number of parts can be minimized and mounting can be done very easily.

In this embodiment, since the mounting structure of thermal head 5 is composed of the head base 111 to which the thermal head 5 is loaded, a holding body which is composed of lever 101 and member 106 and holds the head base 111 and the springs 117, 118, the thermal head 5 can easily be positioned to the specified position opposing to the platen 2 only with a single action of inserting the head base 111 loading the thermal head 5 into the holding body, and the thermal head 5 including the head base 111 can be held reliably without generating any displacement, irrespective of repeated pressurization and unpressurization of thermal head 5, owing to a holding force of the holding body.

Although not shown in this embodiment, color printing can be realized also by assigning different colors to the thermally fusible meterial forming the printing regions 38, 39 and 40 located at the upper, intermediate and lower positions of printing tape 37 shown in FIG. 12.

In the aforementioned embodiment, the tape shift cam 96 rotates in the direction of arrow 132 of FIG. 15(*b*) with rotation of shaft 7, thereby the tape cassette 6 moves from the lower position to the intermediate position and from the intermediate position to the upper position, and printing can be done respectively by the printing regions 38, 39 and 40 of printing tape 37 shown in FIG. 12, namely by the tape from the upper to lower positions of printing tape 37. But it is also possible to rotate the tape shift cam 96 in the direction opposing to that of arrow 132 shown in FIG. 15(*b*) and to move the tape cassette 6 from the upper position to intermediate position and from the intermediate position to the lower position, thereby to realize the printing respectively by the printing regions 40, 39 and 38 of the printing tape 37 shown in FIG. 12, namley by the tape from the lower position to the upper position thereof.

In above embodiment, the worm 10 and slider 15 are rotated by the stepping motors 11, 16 but these stepping motors 11, 16 can be replaced with electromagnetic solenoids.

Moreover, in above embodiment, the rack gear 53 is provided with holes 90 and the frame 1 is provided with the erected portions 91. But, on the contrary, it is possible to provide protrusions to the rack gear 53 and holes to the frame 1 for engagement with said protrusions.

Also, in this embodiment, the protrusion 88 formed to the carriage 4 is engaged with the second edge formed to the frame 1 and the pin 87 which engages with the first edge 84 formed to the frame 1 is loaded to the carriage 4. But, on the contrary, it is also possible to provide the protrusion which engages with the first edge formed to the frame 1 to the carriage 4 and to provide the pin which engages with the second edge 85 formed to the frame 1 and can be loaded to the carriage 4.

Further in this embodiment, the gear 93, restoration cam 94 and pressurized cam 95 are formed integrally but these can also be formed separately.

A thermal printer of the present invention provides, as described above, the cassette shift mechanism, head pressurizing and unpressurizing mechanism and tape wind-stop mechanism in conjunction with rotation of shaft during four strokes of the carriage executes printing in three printing regions of upper, intermediate and lower positions in the width direction of the printing the tape. Accordingly, a quantity of tape to be used and replacement frequency of tape cassette can be reduced, compared with conventional printers, and a high speed printing can be realized, thereby the running cost can be reduced and printing efficiency can also be improved.

What is claimed is:

1. In a thermal printer for printing on a recording paper comprising a platen on which the recording paper is wound, platen rotating means for advancing the recording paper on said platen, a carriage movable reciprocatingly in bi-lateral printing directions along the platen, carriage moving means for driving the carriage bi-directionally along the platen, a thermal head mounted on the carriage and movable toward and away from a printing position against the platen, a tape cartridge mounted on the carriage containing an ink tape wound on a pair of reels and positioning a part of the tape between the thermal head and the recording paper, and tape winding means for winding the ink tape in cooperation with the bi-directional movement of the carriage along the platen;

the improvement comprising:

said ink tape having a plurality of tape regions defined in the vertical direction of the tape transverse to the printing directions, said tape cartridge being shiftable vertically relative to said thermal head for positioning successive one of said regions for printing from a section thereof upon each successive movement of said carriage in said bi-directional printing directions;

tape wind-stop means on said carriage for selectively decoupling said tape winding means upon a return movement of said carraige in order to provide a fresh section of tape for printing;

head pressing means on said carriage for selectively moving the thermal head toward and away from said printing position along said platen;

tape shifting means on said carriage for shifting said tape cartridge vertically to position said regions for printing therefrom; and a single driving means for driving said tape wind-stop means, said head pressing means, and said tape shifting means in cooperation with movement of said carriage in said bi-directional printing directions.

2. A thermal printer according to claim 1, wherein said driving means comprises a stepper motor mounted in said printer, a shaft driven by said motor extending parallel to said platen and on which said carriage is supported, first cam means coupled to said shaft for driving said tape wind-stop means, second cam means coupled to said shaft for driving said head pressing means, and third cam means coupled to said shaft for driving said tape shifting means, said stepper motor being operated to drive said first, second, and third cam means in conjunction with said successive bi-directional movements of said carriage.

3. A thermal printer according to claim 1, wherein said driving means is coupled to said carriage moving means and said platen moving means for cooperatively operating the same in conjunction with said first, second, and third cam means.

* * * * *